United States Patent [19]

Trotta

[11] 3,958,726

[45] May 25, 1976

[54] SAFETY CAP FOR AEROSOL SPRAY CAN

[75] Inventor: Frank A. Trotta, New York, N.Y.

[73] Assignee: Digital Differential Safety Systems, Inc., New York, N.Y.

[22] Filed: Dec. 10, 1973

[21] Appl. No.: 423,262

Related U.S. Application Data

[63] Continuation-in-part of Ser. No. 331,795, Feb. 12, 1973, abandoned.

[52] U.S. Cl. ..... 222/402.13; 222/182

[51] Int. Cl.[2] ..... B65D 83/14

[58] Field of Search ..... 222/153, 182, 402.1, 222/402.11, 402.12, 402.13, 402.15, 402.21, 402.22, 402.23

[56] References Cited

UNITED STATES PATENTS

| | | | |
|---|---|---|---|
| 3,209,953 | 10/1965 | Nichol | 222/182 |
| 3,225,958 | 12/1965 | Frankenberg | 222/402.13 X |
| 3,317,091 | 5/1967 | Focht | 222/402.13 |
| 3,426,948 | 2/1969 | Stirling | 222/402.11 |
| 3,608,785 | 9/1971 | Durso | 222/402.11 X |
| 3,712,515 | 1/1973 | Corll | 222/182 |
| 3,744,682 | 7/1973 | Blank | 222/402.13 X |
| 3,749,286 | 7/1973 | Douglas | 222/153 |
| R26,367 | 4/1968 | Sagarin | 222/402.13 X |

*Primary Examiner*—Robert B. Reeves
*Assistant Examiner*—Frederick R. Handren

[57] ABSTRACT

A safety cap for aerosol spray cans having a passage to afford access by an adult's index finger or middle finger to aerosol can valve actuation means. The cap is configured such that it does not protrude beyond an extension of the cylindrical surface defined by the aerosol can.

12 Claims, 16 Drawing Figures

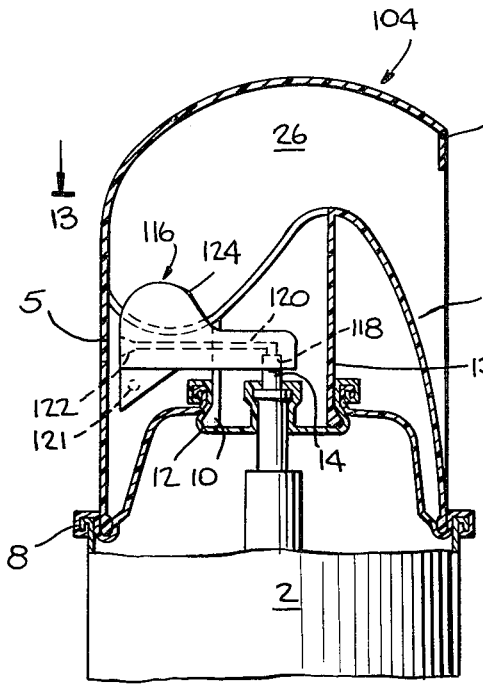
Fig. 10.
Fig. 13.
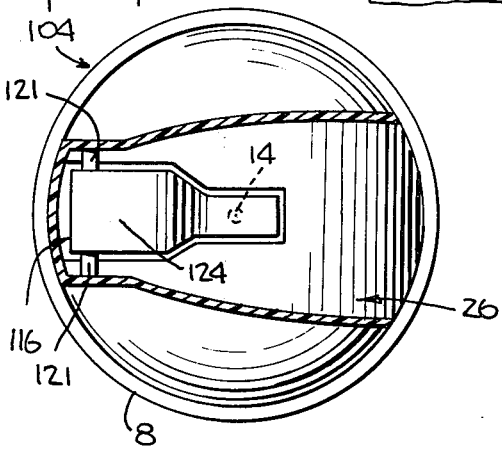
Fig. 12.
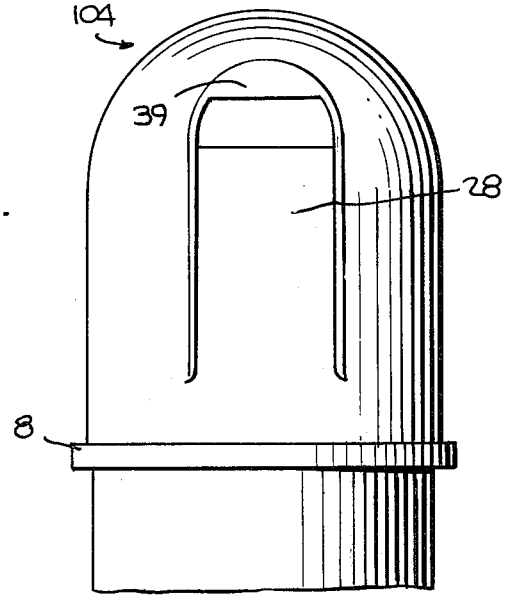
Fig. 11.
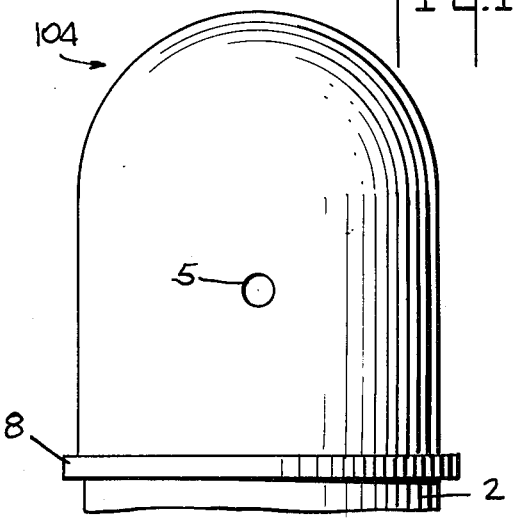

SAFETY CAP FOR AEROSOL SPRAY CAN

CROSS REFERENCE TO RELATED APPLICATIONS

This is a continuation-in-part of Ser. No. 331,795, now abandoned, filed Feb. 12, 1973. The applicant holds U.S. Pat. No. 3,698,543 entitled SAFETY CONTAINER (issued Oct. 17, 1972). The applicant has also applied for a patent on a SAFETY CAP FOR AEROSOL SPRAY CANS Ser. No. 411,736 filed Nov. 1, 1973, now Pat. No. 3,876,113) which is a continuation of Ser. No. 290,824, now abandoned, filed Sept. 21, 1972, which, in turn, is a continuation-in-part of Ser. No. 118,875, now abandoned, filed Feb. 25, 1971.

BACKGROUND OF THE INVENTION

1. Field of the Invention

This application relates to a safety device directed to preventing infants and young children from using potentially dangerous articles. In particular, this invention is directed to a safety device for preventing infants and young children from discharging the contents from aerosol cans.

DESCRIPTION OF THE PRIOR ART

The past twenty years have evidenced a dramatic increase in the fatality and injury rate among children due to accidental poisoning. In many cases, the poisoning was caused by inhalation or ingestion of commercial products marketed in aerosol cans. A variety of safety designs have been developed to prevent children from gaining access to the potentially dangerous contents of aerosol cans. One technique which has been developed by the applicant is the use of a safety cap which has formed therein a passage configured to allow an adult's finger to engage the aerosol can valve actuator button to prevent access thereof by a child.

The safety cap originally developed by the applicant is suitable for virtually all aerosol can applications, however, in certain commercial applications packaging considerations dictate that the cap avoid protruding beyond an extension of the cylindrical surface of the can.

SUMMARY OF THE INVENTION

The invention of this application resides in a safety cap configured to avoid protruding beyond an extension of the cylindrical surface defined by a cylindrical can. The cap is permanently fixed to the can and, under certain circumstances, can be integrally formed with the can. The safety cap is provided with a passage to allow an adult's finger to travel the entire length thereof and actuate the actuator button, but to prevent a child's finger from actuating the actuator button. A child of five years or younger is prevented from actuating the actuator button by the contour of the passage. Either the child's finger cannot reach the actuator button or, if the child's finger does reach the button, the finger joints are so restricted that the finger cannot perform the maneuver necessary to effect actuation. A lever adapted to cooperate with the conventional aerosol valve is provided in the cap structure. One end of the lever is presented at the inner termination of the finger passage in the safety cap and affords the surface on which the finger presses to actuate the aerosol valve. The cap is also provided with seating and locking means to locate the actuation lever properly on the aerosol can valve stem.

BRIEF DESCRIPTION OF THE DRAWINGS

The invention will be better understood when considered with reference to the drawings wherein:

FIG. 10 is a sectional elevational view of the safety cap of still another embodiment of the subject invention;

FIG. 11 is a front elevational view of the safety cap of FIG. 10;

FIG. 12 is a rear elevational view of the safety cap of FIG. 10;

FIG. 13 is a sectional plan view of FIG. 10 taken through line 13—13;

DESCRIPTION OF THE PREFERRED EMBODIMENT

Figure 1:
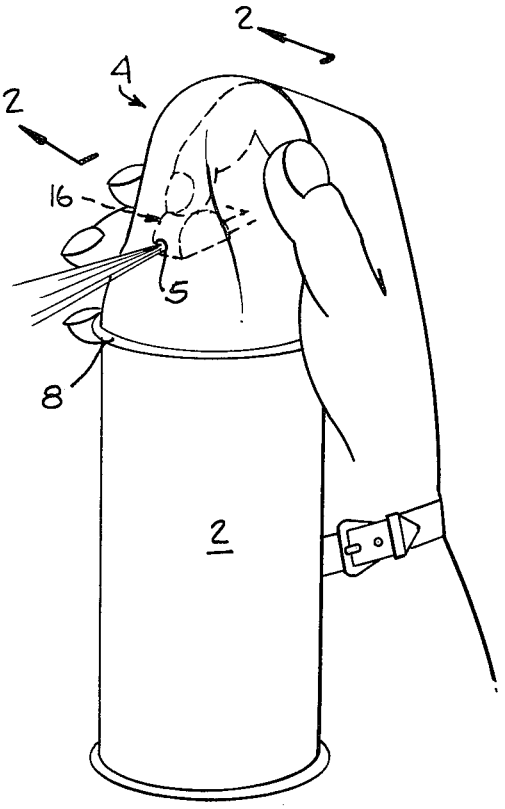
FIG. 1 is a perspective view of one embodiment of the subject invention attached to a conventional aerosol spray can.

The safety cap 4 is provided with means to mount it on an aerosol can 2, a frontal opening 5 for the discharge of the contents of the aerosol can 2, a valve actuator lever 16 and a tunnel 26 to afford access of an adult's finger to the actuation lever 16.

The safety cap 4 of the present invention is shown in the drawings mounted on a conventional aerosol can 2. The safety cap 4 of this invention is characterized by its basic configuration. The safety cap 4 is provided with a configuration which effectively does not have any portion protruding beyond the contour of the aerosol can 2. This design facilitates both packaging and handling of the aerosol can-safety cap assembly. It is important to note that the concept of the invention is a safety cap 4 for aerosol cans 2 which does not have any part of the outer surface 9 that protrudes beyond the contour of the aerosol can. Generally, this is achieved within the scope of this invention by providing the bottom of the cap 4 with a circular cross section and attachment means which grip a structure on the can 2 which is within the contour of the can 2 such as the annular recess 12 (seen in FIG. 2). However, attachment means can also be gripper means on the inside of the cap 2 at the bottom thereof to grip the rim 8. With such arrangement, the outer surface of the cap 2 will protrude slightly beyond the outer surface of rims 7 and 8 of the aerosol can. However, as defined in this patent application, the term "cylindrical surface of the aerosol can" includes the small area increment which is outside of the outer surface of rims 7 and 8 when the cap is provided with internal attachment means that grip the outside of the rims 7 and 8. (See FIGS. 14–16.)

One embodiment of the safety cap 4 of this invention is shown in FIGS. 1–4. The safety cap 4 mounted on a conventional aerosol can 2 is essentially entirely within the area defined by the rim 8 of the aerosol can 2.

Figure 2:
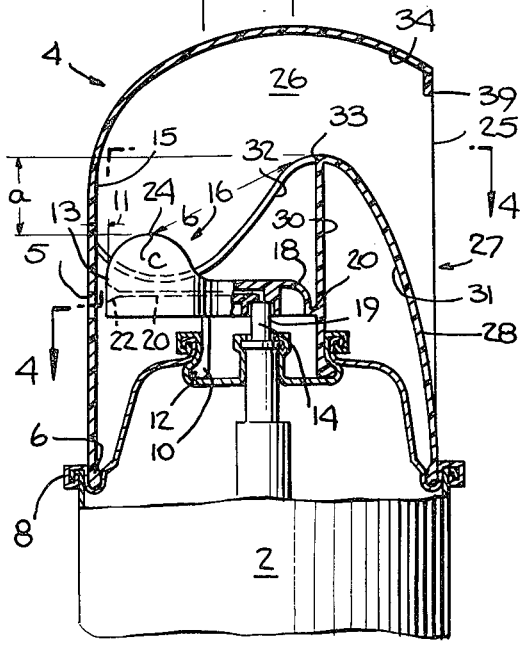
FIG. 2 is a sectional elevational view taken through line 2—2 of FIG. 1.
Figure 4:
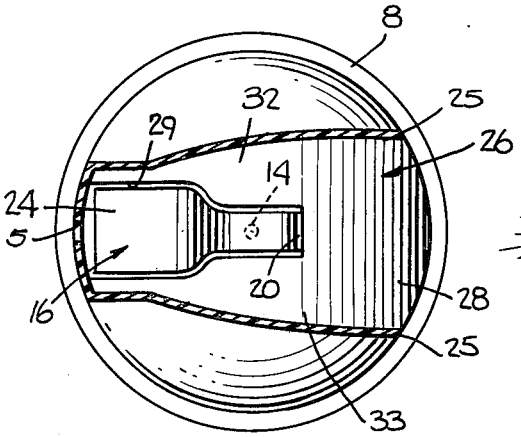
FIG. 4 is a sectional plan view taken through line 4—4 of FIG. 2.
Figure 3:
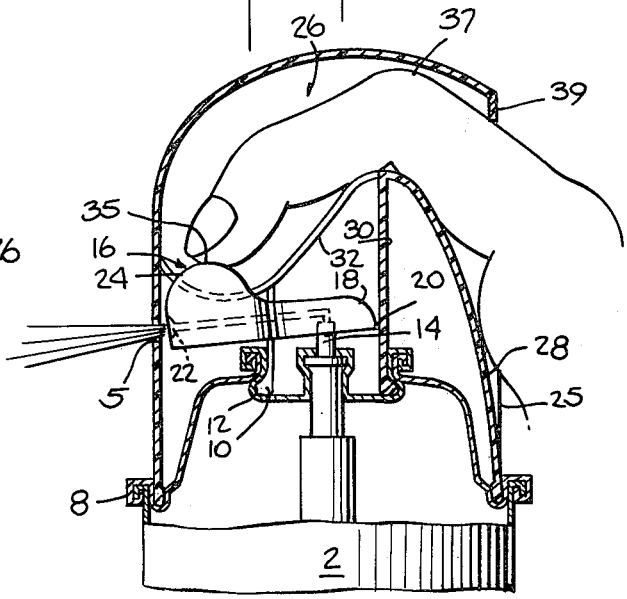
FIG. 3 is the sectional elevational view shown in FIG. 2 with the aerosol can valve actuated.

As best seen in FIGS. 2, 3 and 4, the safety cap 4 is provided with a mounting means 6 which cooperate with the internal flange of the rim 8 to permanently fix the cap to the aerosol can 2. The cap 4 is further provided with an internal flange 10 adapted to cooperate with the annular recess 12 which surrounds the conventional aerosol can valve stem 14. Thus, the cap 4 is secured to the aerosol can 2 by means of both an internal flange 6 and an internal flange 10. The internal flange 10 is connected to the structure of the safety cap 4 at the undersurface 31 of the tunnel floor by means of a structure 30 which can be configured cylindrically or of some other similar configuration.

The cap 4 includes an actuator member 16, best seen in FIGS. 2–4. The actuator member 16 is essentially a lever and is mounted at its rear end 18 by a hinge 20 which connects to the cylindrical structure 30. The actuation member 16 is provided with an essentially circular indentation or recess 19 which is designed to mate with the aerosol can valve stem 14. An internal passage 20 extends from the indentation 19 through the body of the actuation lever member 16 to the front of the actuation lever 16 wherein it terminates in an opening 22. The diameter of the opening 22 may be slightly larger than the diameter of the passage 20. An enlarged protuberance 24 is formed on the front of the actuation lever 16 to afford a surface against which pressure can be applied to rotate the actuation lever 16 about hinge 20. Rotation of the lever 16 about hinge 20 serves to exert a downward pressure on valve stem 14 to discharge the contents of the aerosol can through passage 20, opening 22 and ultimately the frontal opening 5 of the safety cap 4.

The enlarged member 24 of the actuation lever 16 is located in proximity to and generally above the frontal opening 5 of the safety cap 4. In the at rest position, the opening 22 is located slightly above the frontal opening 5 in the safety cap 4. When the actuation member 16 is depressed enough to release the contents of the aerosol can 2, the opening 22 is brought into alignment with the opening 5. An allowance 11 between the front 13 of the actuator lever 16 and the front wall 15 of the safety cap can be provided to facilitate travel of the lever 16 and to provide a space to accommodate a large fingernail.

The internal passage 26 in the safety cap 4 allows an adult's finger to reach the enlarged member 24 of the actuation lever 16, but prevents access thereto by a child. The passage 26 is open at opening 27 and is defined by a rear lower surface 28, forward lower surface 32 and upper surface 34. As best seen in FIG. 4, the forward lower surface 32 is provided with an opening 29 to allow vertical travel of the actuation lever 16 in general and the extended pressure surface 24 in particular.

The opening 27 is defined by a continuous edge 25 which prevents deep penetration of the finger into the passage. The continuous edge 27 acts as a stop or barrier against the web of the finger.

The passage 26 is similar but not identical to the safety caps disclosed in applicant's other inventions which appear in the patent and patent application identified in the section entitled "CROSS REFERENCE TO RELATED APPLICATIONS." An essentially central elevated portion 33, located at the position where the rear lower surface 28 and the forward lower surface 32 meet, is located at an elevation above the surface of the member 24 and a distance therefrom which is approximately the distance of an adult's finger from the tip 35 to the second knuckle 37, as best seen in FIG. 3.

The cross-sectional area of the passage 26 is ¾to 1½ square inch and the length to the actuation device is approximately 2 to 2½ inches. Data has shown that the adult's index and middle finger are in the range of 2⅜ to 3¾ inches and has an effective cross-sectional area of 0.10 to 0.59 inch. A young child's finger (five years old) or an infant's finger seldom reaches a length greater than 1⅞ inches. The basic design of the passage 26 provides contour to prevent access by any rigid objects. The elevation 33 is of sufficient height to insure that the depending rear wall 39 of the upper surface 34 is out of line of sight of the member 24. Thus, rigid objects are prevented from traveling through the passage 26 to the member 24 on the actuator lever 16.

Figure 5:
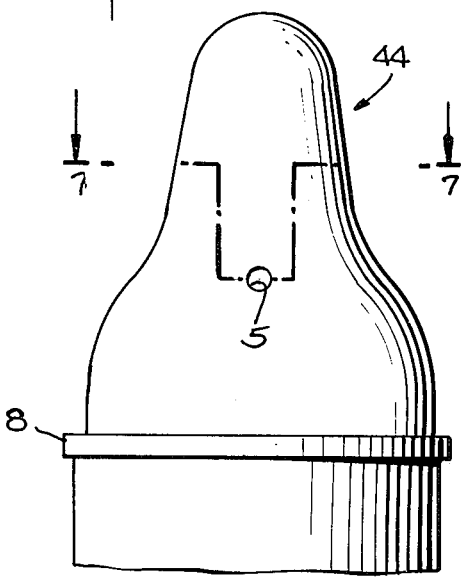
FIG. 5 is a front sectional view of another embodiment of the safety cap of the subject invention.

The embodiment of FIGS. 5–8 differs somewhat from the embodiment of FIGS. 1–4. The front view of the embodiment of safety cap 44 is seen in FIG. 5, wherein the frontal opening 5 is shown, and in FIG. 6 wherein the rear opening 28 is shown.

Figure 8:
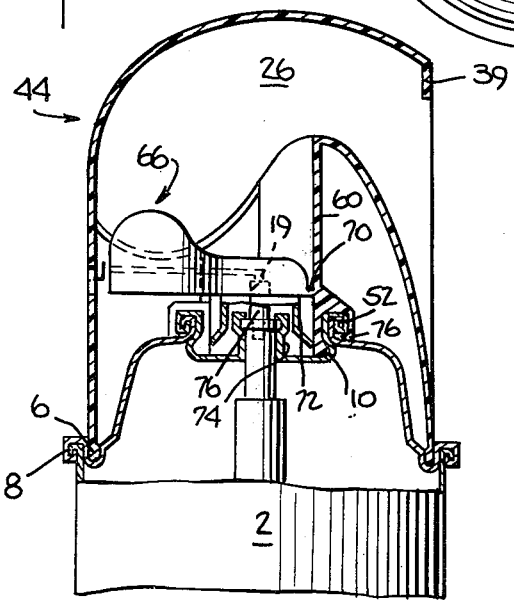
FIG. 8 is a sectional elevation view taken through line 8—8 of FIG. 7.

The valve actuation member 66 is configured differently from the actuator button seen in the embodiment of FIGS. 1–4. As best seen in FIG. 8, the valve actuator member 66 is attached by a hinge 70 to the wall 60 which depends from the bottom of the tunnel 26. The valve actuation member 66 is provided with alignment means 72 in the form of an inverted, truncated cone. The truncated cone cooperates with the mount 74 for the aerosol stem valve 76 to provide alignment of the stem valve 76 with the indentation or recess 19 in the valve actuating means 66. Securement means is provided for the cap 44 in the form of concentrically arranged flanges 6, 10 and 76. Flanges 76 and 10 cooperate to surround the collar 52 found on the conventional aerosol can and flange 6 which fits in the recess next to rim 8.

The tunnel 26 is configured essentially the same as the tunnel 26 seen in the embodiment of FIGS. 1–4.

Figure 9:
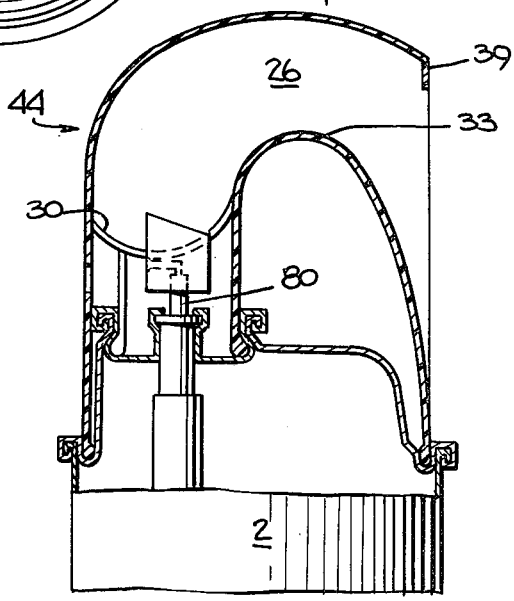
FIG. 9 is a sectional elevational view of another embodiment of the subject invention.

The embodiment of FIG. 9 discloses a modified aerosol can with the valve stem 80 offset from the vertical axis of the conventional can 2 to mate properly with the safety cap 44 of the present invention. The funnel 26 with the elevation 33, depending rear wall 39 and tunnel floor opening 30 is the same as the tunnel of each of the other embodiments.

The embodiment of FIGS. 10–13 is an aerosol cap 104 shown mounted on an aerosol can 2 provided with a conventional flange 8. The safety cap 104 is provided with an internal flange 10 adapted to fit in the conventional recess 12 found in the collar of a conventional aerosol can 2. The flange 10 is attached to the safety cap 104 by a circular structural wall 130. The valve actuation member 116 in this embodiment is provided with an indentation 118 to mate with the conventional aerosol valve stem 14, an internal pasage 120 and an opening 122. The actuator button 116 is again provided with an extended frontal protuberance 124 to provide a pressure surface for the finger of an adult. The valve actuation member 124 is mounted to the safety cap 104 by transverse hinges 121, best seen in FIG. 13. The opening 122 in the actuator button 116 is aligned with the opening 5 in the safety cap 104. Thus, in operation, the rear of the button 116 will deflect downwardly. Unlike the other embodiments of the invention, the opening 122 need not move downwardly to come into registry with the opening 5 when the valve stem 14 has been depressed sufficiently to release the contents of the can 2.

Figure 6:
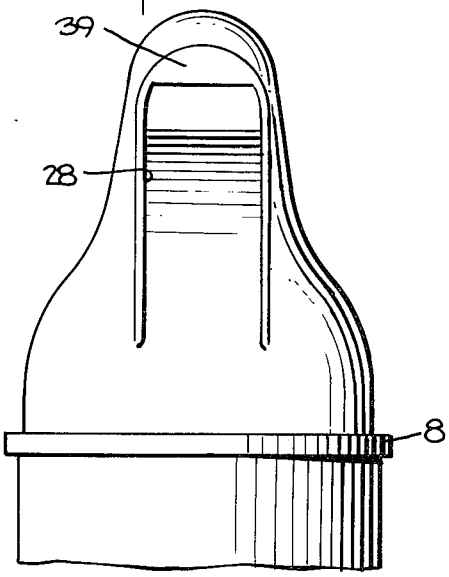
FIG. 6 is a rear elevational view of the safety cap of the subject invention.
Figure 7:
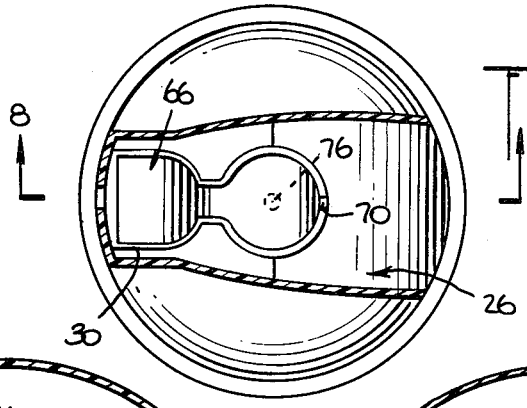
FIG. 7 is a sectional plan view taken through line 7—7 of FIG. 5 showing a variation of the actuation lever of the subject invention.

The embodiment of FIGS. 10–13 is displayed in FIG. 11 to show the frontal profile opening 5 and in FIG. 12 to show the rear opening 28. The configuration of the safety cap 104 in this embodiment is dome-like. The configuration of the safety cap 4 in the other embodiments is sculptured, as best seen in FIGS. 5 and 6.

Out of line of sight has been used throughout the specification to define the relationship of the depending rear wall 39, the elevation 33 in the tunnel floor and the surface 24. The term out of line of sight means that a rigid object cannot pass through the tunnel and bear on the surface 24 to actuate the lever 16. The depending rear wall 39 and the elevation 33 are arranged such that a rigid object, regardless of how narrow the gauge, cannot rotate around the elevation to depress the actuator lever 16.

The relationship between the elevation 33 and the surface 24 is an essential part to the applicant's invention. As seen in FIG. 2, the combination of the elevational difference *a* between the elevation 33 and the surface 24 and the actual distance *b* between the elevation 33 and the point *c* on the surface 24 is chosen to allow actuation of the actuator button by an adult's finger but not a child's finger. In addition to reliance on difference in length between a child's finger and an adult's finger, the concept of the invention also relies on the principle of joint articulation. The arc made by rotating the finger from the second joint from the tip about the elevation 33 is critical. Thus, the critical dimensions are chosen to allow an adult's finger to rotate about elevation 33 to depress the lever 16, but to prevent a child's finger from doing so.

Figure 15:
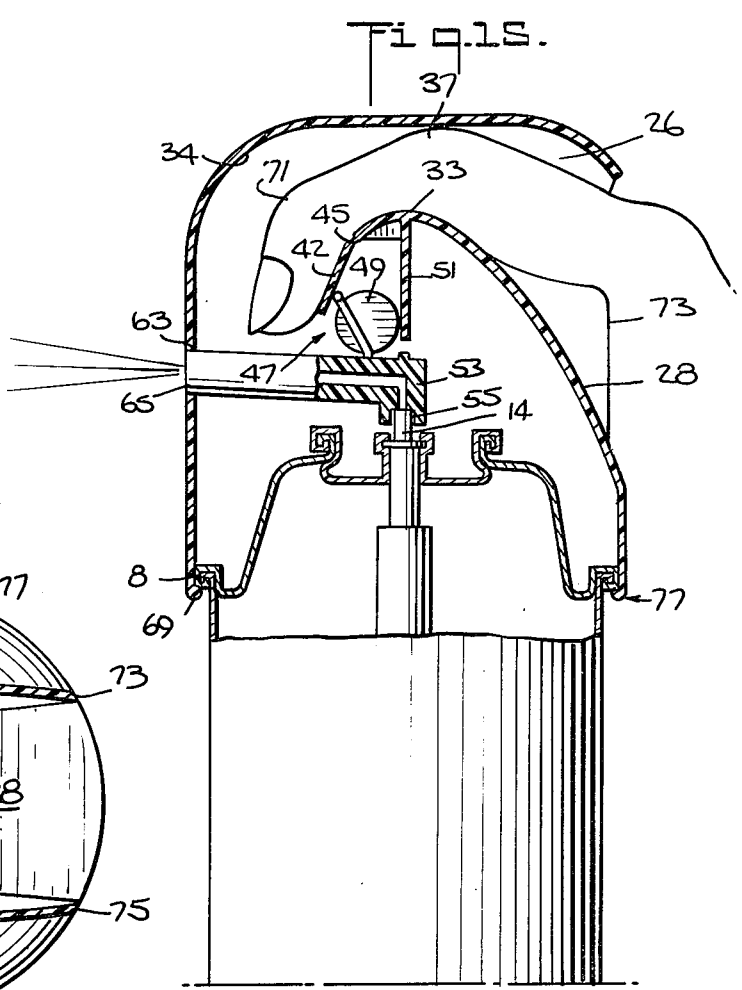
FIG. 15 is the same sectional elevational view of the safety cap embodiment of FIG. 14 showing the valve being actuated by an adult's finger.
Figure 16:
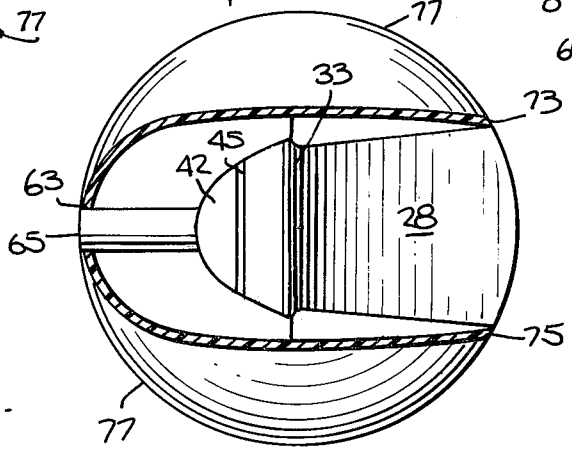
FIG. 16 is a plan view through line 16—16 of FIG. 14.
Figure 14:
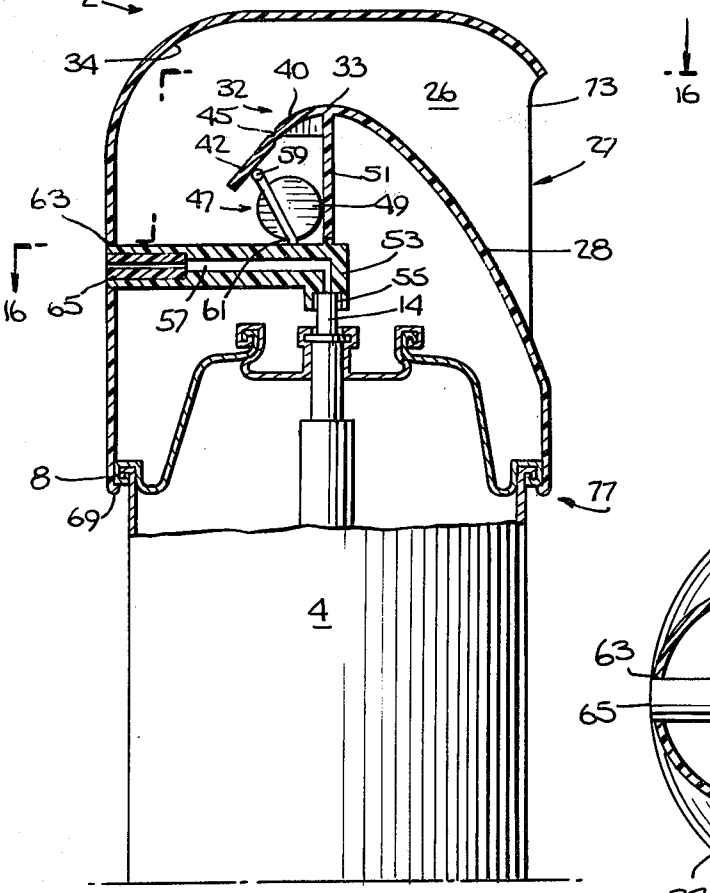
FIG. 14 is a sectional elevational view of another embodiment of the aerosol safety cap of the invention.

The embodiment of FIGS. 14, 15 and 16 is a safety cap 4 of the subject invention wherein the principle employed is plural articulation.

In the embodiment of FIGS. 14–16, the cap 2 is again provided with a passage 26 having curved cross-sectional shape. The passage 26 extends from a rear access opening 27. The floor of the passage has a central point 33 which is the highest point in the curved path, a rear lower surface 28, a forward lower surface 32 and an upper surface 34. The forward lower surface 32 is comprised of a fixed surface 40 and a movable surface 42, the movable surface 42 being hinged to the fixed surface 40 at hinge 45.

An actuator assembly 47 is provided to afford accuation of the aerosol can valve stem 14. In this particular embodiment, the actuator assembly 47 comprises a cam wheel 49, a wall 51 and an actuator passage member 53. The actuator passage member 53 is provided with a circular recess 55 which is sized to accept the valve stem 14. A fluid passage 57 extends from the recess 55 to the front of the actuator passage member 53. The wall 51 is arranged perpendicular to the actuator passage member 53 and serves as a reaction member for the cam wheel 49. The cam wheel 49 has extensions 59 and 61 formed thereon. The extension 59 abuts the bottom of the movable surface 42 and the extension 61 is attached to the actuator passage member 53. The cam wheel 49 bears against the wall 51. Application of force on the surface 42 will transmit force through cam extensions 59 and 61 to depress the valve stem 14 as best seen in FIG. 15.

This particular embodiment of the invention illustrates another structure which prevents frontal actuation. The front 65 of the actuator passage member 53 is configured the same as the discharge opening 63 in the safety cap 4. Thus, the front 65 of the actuator passage member fits snugly in the discharge opening 63. The actuator passage member 53 is sized to extend from the valve stem 14 to the discharge opening 63 such that the front 65 of the actuator passage member is flush with the outer surface of the cap 4.

The attachment means illustrated by the cap 4 embodied in FIGS. 14–16 grips the outside of rim 8. A flange 69 extending inwardly from the inside surface of the cap 4 grips the lower surface of the rim 8 to attach the cap 4 to the aerosol can 2. With this attachment means the bottom 71 of the cap 4 has a slightly larger cross-sectional surface area than the aerosol can 4, as best seen in FIG. 16. However, the size difference is not appreciable and the benefit of an aerosol can safety cap 4 without any protruding structure which extends beyond the surface 9 of the aerosol can 4 is maintained.

The embodiment of FIGS. 14–16 relies on a plural articulation concept. As best seen in FIG. 15, the passage 26 is of such length that the second knuckle or joint 37 of an adult's finger can reach the highest point 33 in the passage 26. Further, the fixed surface 40 in the passage is sized to extend from the second joint 37 of an adult's finger to the first joint 71. The fixed structure 40 supports the finger from the second knuckle or joint 37 to the first joint 71. The only pressure than can then be exerted at the movable surface 42 is that force provided by the fingertip 35.

This concept of plural articulation further insures against actuation by a child without inhibiting an adult from actuating the spray. The entry 27 to the passage 26 is sized to prevent line-of-sight access to the movable surface 42. The cap has a depending section 39 that defines the upper surface of the opening 27. Further the top 39 of the opening 27 is at an elevation above section 33 which prevents a finger from entering the passage 26 at an angle. The finger must enter the passage parallel to the flat top and bottom of the aerosol can. The elevational difference between depending wall 39 and the surface 33 is approximately the size of an adult's finger width.

The width of the opening 27 is sized to allow entry of one adult finger and has side edges 73 and 75 against which the web of a hand bears when a finger is inserted in the opening 27.

FIGS. 14–16 show the "cylindrical surface of the aerosol can" as defined in this invention as the outside line 77.

I claim:

1. A safety cap for an aerosol can comprising:

a tunnel having a floor and ceiling and having one end open to the exterior and an internal opening at the end remote from the end open to the exterior which tunnel extends diagonally across the safety cap and is configured to afford passage by an adult's finger to the internal opening therein, but prevent passage by a child's finger to the internal opening therein;

said floor having an elevated portion disposed intermediate the ends of the tunnel, the top of which elevated portion is located above the tunnel internal opening and above the lowermost portion of the tunnel exterior opening and is a distance from the tunnel internal opening which distance is the length of an adult's index finger from the second joint to the first joint;

means for rendering the tunnel end open to the exterior and the tunnel internal opening out-of-line of sight;

an outer surface confined substantially within the space defined by an extension of the cylindrical surface of the aerosol can;

an actuation assembly for actuating the aerosol can valve, which actuation assembly has a pressure surface at the internal opening in the tunnel;

a fluid passage in the actuation assembly having a frontal discharge opening, which fluid passage extends from a location on the actuation assembly which bears on the valve stem of the aerosol can to the frontal discharge opening;

a discharge opening in the safety cap arranged for alignment with the discharge opening in the actuation assembly when the actuation member has been depressed to actuate the aerosol can valve; and means to mount the safety cap on an aerosol can.

2. A safety cap as in claim 1 further comprising an inverted truncated conical section depending from the actuation assembly concentrically about the point wherein the valve stem engages the actuation assembly which truncated conical section is sized slightly larger thana the aerosol can structure which mounts the aerosol can valve stem.

3. A safety cap as in claim 1 wherein the means to mount the safety cap on the aerosol can is comprised of a first annular flange adapted to force fit within the recess adjacent the bead of a conventional aerosol can and a second annular flange concentrically disposed within the first annular flange arranged to force fit within the recess on the aerosol can surrounding the valve stem.

4. A safety cap as in claim 3 wherein the second annular flange is provided with both internal and external flanges to grip the annular collar surrounding the aerosol valve stem.

5. A safety cap as in claim 1 wherein the discharge opening in the actuation lever is located at an elevation higher than the discharge opening of the safety cap when the lever is not being depressed.

6. A safety cap as in claim 1 further comprising means to prevent actuation of the actuation lever by access through the frontal opening in the safety cap.

7. A safety cap as in claim 1 further comprising an allowance area between the internal wall of the safety cap and the front of the actuator lever to accommodate a large fingernail.

8. A safety cap as in claim 1 wherein the fluid passage extends to and fits snugly within the discharge opening in the safety cap.

9. A safety cap for an aerosol can as in claim 1 wherein the means for rendering the tunnel end open to the exterior and the tunnel internal opening out-of-line of sight is a spaced relationship between the top of the tunnel end open to the exterior and the elevated portion in the tunnel wherein the elevation of the top of the tunnel end open to the exterior is above the elevation of the elevated portion in the tunnel a distance equivalent to the width of an adult's finger.

10. A safety cap for an aerosol can comprising:

a tunnel having a floor and a ceiling and having one end open to the exterior and an internal opening at the end remote from the end open to the exterior which tunnel extends diagonally across the safety cap and is configured to afford passage by an adult's finger to the internal opening therein, but prevent passage by a child's finger to the internal opening therein;

said floor having an elevated portion disposed intermediate the ends of the tunnel, the top of which elevated portion is located above the tunnel internal opening and above the lowermost portion of the tunnel exterior opening and is located a distance from the tunnel internal opening which distance is the length of an adult's index finger from the second joint to the first joint and at an elevation below the rear top opening of the tunnel equivalent of the width of an adult's finger;

an outer surface confined substantially within the space defined by an extension of the cylindrical surface of the aerosol can;

a movable surface hingedly mounted to the tunnel at the internal opening;

an actuating assembly for actuating the aerosol can valve;

means for transmitting force from the movable surface to the actuating assembly;

a fluid passage in the actuation assembly having a frontal discharge opening, which fluid passage extends from a location on the actuation assembly which bears on the valve stem of the aerosol can to the frontal discharge opening;

a discharge opening in the safety cap arranged for alignment with the discharge opening in the actuation lever when the actuation member has been depressed to actuate the aerosol can valve; and means to mount the safety cap on an aerosol can.

11. A safety cap as in claim 10 wherein the actuation lever is mounted on the safety cap by hinges extending transversely from the front of the lever in proximity to the frontal discharge opening therein.

12. A safety cap as in claim 10 wherein the means for transmitting the force from the movable surface to the aerosol valve stem is comprised of a centrally disposed wall, a cam wheel, an actuator passage member and cam extensions extending respectively to the lower surface of the movable surface and to the actuator passage assembly.

* * * * *